US007011305B2

(12) United States Patent
Förch et al.

(10) Patent No.: US 7,011,305 B2
(45) Date of Patent: Mar. 14, 2006

(54) DEVICE AND METHOD FOR ALIGNING SHEETS

(75) Inventors: Peter Förch, Neustadt (DE); Andreas Henn, Neckargemünd (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 0 days.

(21) Appl. No.: 09/847,699

(22) Filed: May 2, 2001

(65) Prior Publication Data

US 2001/0040331 A1 Nov. 15, 2001

(30) Foreign Application Priority Data

May 2, 2000 (DE) ..... 100 21 034

(51) Int. Cl.
*B65H 9/00* (2006.01)

(52) U.S. Cl. ..... 271/226; 271/227; 271/236; 271/250

(58) Field of Classification Search ..... 271/226, 271/227, 236, 250
See application file for complete search history.

(56) References Cited

U.S. PATENT DOCUMENTS 4,547,115 A * 10/1985 Charbonnet ..... 414/796.4
5,140,166 A * 8/1992 Gerlier ..... 271/227
5,322,012 A * 6/1994 Gartner et al. ..... 101/232
5,634,636 A * 6/1997 Jackson et al. ..... 271/225
5,788,228 A * 8/1998 Moll ..... 271/225
5,984,301 A * 11/1999 Holbert et al. ..... 271/227
6,113,092 A * 9/2000 Greive et al. ..... 271/113
6,155,561 A * 12/2000 Mandel ..... 271/254
6,209,866 B1 * 4/2001 Hosking et al. ..... 271/228

FOREIGN PATENT DOCUMENTS

| | | |
|---|---|---|
| DE | 745271 | 10/1953 |
| DE | 2452051 | 5/1976 |
| DE | 2520232 | 11/1976 |
| DE | 19822307 | 1/1999 |
| DE | 19804120 A1 | 8/1999 |

* cited by examiner

*Primary Examiner*—Eileen D. Lillis
*Assistant Examiner*—Michael Lowe
(74) *Attorney, Agent, or Firm*—Laurence A. Greenberg; Werner H. Stemer; Ralph E. Locher

(57) ABSTRACT

A device for aligning sheets prior to transferring the sheets to a sheet-processing machine includes at least one sheet-gripping device by the aid of which the sheet to be aligned is displaceable, the sheet-gripping device having at least one positioning table displaceable by an actuating drive in at least one of a sheet travel direction, transversely to the sheet travel direction, and in a direction wherein it is pivoted about an axis extending in a direction orthogonal to the sheet travel direction, the sheet to be aligned being fixable on the positioning table; and a method for aligning sheets by the device.

20 Claims, 8 Drawing Sheets

DEVICE AND METHOD FOR ALIGNING SHEETS

BACKGROUND OF THE INVENTION

1. Field of the Invention

The invention relates to a device and a method for aligning sheets prior to transferring the sheets to a sheet processing machine.

The published German Patent Document DE 198 22 307 A1 discloses a device of the type mentioned herein which has a sheet entrainer formed by a transporting roller and serving for aiding in a displacement, over a fixed distance transversely to a sheet travel direction, of a sheet having a leading edge thereof abutting front lays, until a lateral edge of the sheet strikes against side lays. It has been found that in-register alignment of the sheets cannot be ensured in all cases because the sheet can twist as it strikes against the side lays, thereby forming an aligning-error angle. It is also disadvantageous that the outlay for controlling the movement of the entrainer in order to displace the sheet over a precise distance is very high, and the construction of the device involves great outlay.

SUMMARY OF THE INVENTION

It is accordingly an object of the invention to provide a device and a method of the type mentioned in the introduction hereto wherein in-register alignment of the sheets can be ensured.

With the foregoing and other objects in view, there is provided, in accordance with one aspect of the invention, a device for aligning sheets prior to transferring the sheets to a sheet-processing machine, comprising at least one sheet-gripping device by the aid of which the sheet to be aligned is displaceable, the sheet-gripping device having at least one positioning table displaceable by an actuating drive in at least one of a sheet travel direction, transversely to the sheet travel direction, and in a direction wherein it is pivoted about an axis extending in a direction orthogonal to the sheet travel direction, the sheet to be aligned being fixable on the positioning table.

In accordance with another feature of the invention, the positioning table has at least one contact surface engageable by the sheet, the contact surface being formed with at least one opening connectable to a negative-pressure source.

In accordance with a further feature of the invention, the positioning table is formed with a plurality of openings, respectively, connected to different negative-pressure chambers, which are separated from and disposed side-by-side one another, as viewed in the sheet travel direction, the negative-pressure chambers being connected to the negative-pressure source independently of one another.

In accordance with an added feature of the invention, the positioning table is integrated in a feeding table.

In accordance with an additional feature of the invention, the positioning table has an underside facing away from the contact surface thereof, and including a plurality of elastic bars engaged by the positioning table at the underside thereof so that the weight of the positioning table is supported thereby.

In accordance with yet another feature of the invention, the positioning table is constructed as at least one of a ball table and a compound-table arrangement.

In accordance with yet a further feature of the invention, the actuating drive has an electromagnetic positioning unit with at least one electromagnet, which is fixed in position relative to the positioning table and is assigned to one of a circumferential region of the positioning table and to a location arranged beneath the positioning table.

In accordance with yet an added feature of the invention, the electromagnet is U-shaped.

In accordance with yet an additional feature of the invention, the positioning table is of polygonal construction.

In accordance with still another feature of the invention, the positioning table is square.

In accordance with still a further feature of the invention, the sheet-aligning device includes a sheet-detection device for determining the position of at least one of a leading sheet edge and a lateral sheet edge and having at least one position sensor for detecting the sheet edge in the direction of the sheet surface.

In accordance with still an added feature of the invention, the position sensor assigned to the leading sheet edge is disposed on a pregripper cyclically displaceable with the machine.

In accordance with still an additional feature of the invention, the position sensor is formed by one of a CCD (charge coupled device)-array camera, a capacitive sensor and an ultrasonic sensor.

In accordance with another feature of the invention, the sheet-aligning device includes a control and/or regulating device for activating the at least one electromagnet.

In accordance with a further feature of the invention, the sheet-aligning device includes a control and/or regulating device for adjusting the negative pressure to which the at least one opening formed in the contact surface of the positioning table is subjected.

In accordance with an added feature of the invention, the sheet-detection device is coupled with a control and/or regulating device to form a regulating circuit.

In accordance with an additional feature of the invention, the sheet-aligning device includes a measuring device for determining the electric current flowing through the at least one electromagnet.

In accordance with yet another feature of the invention, the sheet-aligning device includes at least one Hall-effect sensor disposed in a bearing gap between the positioning table and at least the one electromagnet.

In accordance with yet a further aspect of the invention, there is provided a method of aligning sheets prior to transferring the sheets to a sheet-processing machine, which comprises gripping by at least one sheet retainer a respective sheet to be aligned, displacing the sheet into a desired position, and contactlessly aligning at least one of a leading sheet edge in a direction transverse to a sheet travel direction and of lateral sheet edges in a direction parallel to the sheet travel direction.

In accordance with a concomitant mode, the method of the invention includes, before gripping the sheet by the sheet retainer, stopping the sheet by at least one stop acting in the sheet travel direction.

In order to achieve the objective of the invention, there is thus provided a device having at least one sheet-gripping arrangement by which the sheet to be aligned, respectively, is displaceable. The aligning device is distinguished in that the sheet-gripping arrangement has at least one positioning table whereon the sheet to be aligned can be fixed. For the purpose of aligning this sheet, it is possible, by an actuating drive, for the positioning table to be displaced, preferably in a translatory manner, in a sheet travel direction and/or transversely to the sheet travel direction, and/or to be pivoted about an axis extending in a direction orthogonal to the sheet travel direction, i.e., perpendicular to the direction of the sheet surface. The aligning device allows in-register alignment of the sheet without any pulling arrangements and transporting rollers, as are necessarily required for conventional devices of this general type. It is also advantageous that, with precise control or regulation of the displacement movement of the positioning table and precise, slippage-free or at least approximately slippage-free fixing of the sheet on the positioning table, it is possible to dispense with side lays and, if desirable or necessary, also front lays. In other words, the sheet-gripping device according to the invention allows in-register alignment of the previously separated sheet fixed on the positioning table without having to move the sheet up so that edges thereof engage stops, for this purpose.

In a preferred exemplary embodiment of the aligning device, the sheet to be aligned is retained forcelockingly on the positioning table, without requiring mechanical devices. In this regard, it is noted that a forcelocking connection is one which connects two elements together by force external to the elements, as opposed to a formlocking connection which is provided by the shapes of the elements themselves. Thus, a preferred alternate embodiment provides for the positioning table to have at least one contact surface for the sheet with at least one opening which can be connected to a negative-pressure source. The sheet is thus attached by suction on the positioning table and thus retained in a slippage-free manner, with the result that, even in the case of high accelerations of the positioning table, the position of the sheet fixed thereon does not change relative to the positioning table. Another embodiment provides, as an alternative or in addition to the suction device, a plurality of grippers which are preferably assigned to the leading sheet edge and can be moved along with the positioning table.

In a preferred embodiment of the aligning device, the positioning table is integrated in a feeding table, which is, for example, part of a feeder of the machine. In this context, the term "integrated" is understood to mean that the contact surface of the positioning table and a contact surface of the feeding table for the sheets are located in a common plane, thereby forming an overall very smooth contact surface for the sheets over which the latter are pulled and/or pushed individually. In other words, the contact surface of the positioning table thus does not project radially beyond the contact surface of the feeding table, with the result that the edges of the sheets transported over the feeding table do not strike against the positioning table.

According to a first alternate embodiment, the positioning table is arranged in a cutout or gap formed in the central region of the feeding table, the cutout having a closed circumferential surface. In another alternate embodiment, the positioning table is located in an open-margin or open-border aperture in the feeding table, it being possible for the aperture to be introduced, for example, into that side of the feeding table which is directed towards the machine. In both alternate embodiments, the contact surface of the positioning table may be smaller, in particular considerably smaller, than that of the feeding table. In particular, in an alternate embodiment wherein it is arranged in an open-border aperture, the positioning table may be of precisely the same width as the widest sheet, i.e., as the largest sheet format. In this configuration and arrangement of the positioning table, it is necessary, in the case of smaller formats, for that surface area on the contact surface which is subjected to negative pressure to be correspondingly reduced in size. This is realized, for example, in that, in the contact surface, there are provided a plurality of openings which are connected to different negative-pressure chambers which are separated from one another and arranged side-by-side, as viewed in the sheet travel direction. In the case of a smaller format, the negative-pressure chambers connected to those openings which are not covered by the sheet located on the feeding table are switched off, i.e., separated from the negative-pressure source. The operations of switching the negative-pressure chambers on and off can take place manually or preferably automatically, in particular in a self-detecting manner.

Moreover, a preferred exemplary embodiment of the aligning device is one wherein, for the purpose of supporting the weight of the positioning table, a plurality of elastic bars are provided with which the positioning table engages at the underside thereof, which faces away from the contact surface. The bars, which preferably have a high level of inherent elasticity, are preferably arranged so that the positioning table engages, respectively, one of the end sides of the bars, that is to say, the longitudinal central axes of the bars extend at least approximately perpendicularly to the direction of the sheet surface. In an advantageous embodiment, the elastic bars are connected to the preferably light-weight-construction positioning table and retain the latter in a starting position, wherein the respective sheet which is to be aligned is received. With a displacement of the positioning table in or transversely to the sheet travel direction, or with pivoting of the positioning table within the plane of the contact surface, by the actuating drive, the bars are bent and/or subjected to a torque, it being the case that, when the positioning table is released by the actuating drive, the positioning table is automatically returned to the starting position thereof due to the elastic properties of the bars. The mounting of the positioning table is distinguished by a relatively simple construction.

In a further exemplary embodiment of the aligning device, the positioning table is constructed as a ball table, it being possible for the underside of the positioning table and/or a supporting surface with which the positioning table engages by the underside thereof, to have balls over which the positioning table slides during an aligning movement. In another alternate embodiment, the positioning table is formed by a compound-table arrangement which has, for example, at least two slides arranged above one another and being displaceable relative to one another, the displacement direction of a first slide extending parallel to the sheet travel direction and the displacement direction of the second slide extending transversely to the sheet travel direction. In order for at least the top slide, whereon the contact surface for the sheet is located, to be pivoted about an axis running perpendicularly to the sheet surface, a bearing is provided, in particular a ball bearing. All the different embodiments of the positioning table preferably have in common the fact that the table has at least three degrees of freedom, so that it is correspondingly possible for the leading and lateral edges of the sheet fixed on the positioning table to be aligned in relation to the sheet travel direction.

A further exemplary embodiment of the aligning device provides for the actuating drive to have an electromagnetic positioning unit which is arranged in a stationary manner in relation to the positioning table and has electromagnets which are assigned to the circumferential region of the positioning table. A displacement of the positioning table, which is formed of a ferromagnetic material on at least part of the circumferential region thereof, is achieved by correspondingly activating individual electromagnets of the electromagnetic positioning unit, as a result of which there is a change in the current flowing through the electromagnets and thus in the magnet-bearing forces. Consequently, the positioning table is pulled a defined distance out of the stable equilibrium thereof (starting position), with the result that very precise alignment of the sheet fixed on the positioning table is possible. A displacement of the positioning table within a range of a number of millimeters is possible with the aid of the electromagnetic positioning unit. The electromagnets also offer the advantage that they have high regulating dynamics, so that the transient times are then short. The actuating drive according to the invention also has a long service life because, due to the contact-free interaction with the positioning table, no mechanical wear occurs. In another alternate embodiment of the aligning device, the electromagnets are arranged beneath the positioning table.

A particularly advantageous exemplary embodiment of the aligning device is distinguished in that the positioning table is of polygonal construction, with at least each corner of the positioning table having an electromagnet assigned thereto. Provision may be made, in this case, in order to displace the positioning table for the purpose of aligning the sheet retained on the positioning table, for mutually opposite electromagnets to be activated so that, in one electromagnet, the attracting action is increased and simultaneously, in the other electromagnet, the repelling action is reduced (differential actuation).

In order to achieve the objective of the invention, there is also provided a method of aligning sheets prior to transferring the sheets to a sheet-processing machine, in particular a sheet-fed printing machine, wherein the respective sheet to be aligned is gripped by at least one sheet retainer and displaced into a desired position. The method is distinguished in that contactless alignment of the leading sheet edge is effected in a direction transverse to a sheet travel direction and/or of the lateral sheet edges in a direction parallel to the sheet travel direction. There is thus no need for any side lays or front lays serving as stops for aligning the sheets, so that deformation of the sheet, in particular damage to the sheet edges, can be ruled out. The method can advantageously be used, in particular, for sheets having flexible properties, for example sheets of paper or cardboard or pasteboard, sheet-metal panels or the like, because, as they strike against a front or side lay, such sheets tend to deform elastically, with the result that, upon release of the sheet retainer, the sheet springs back into the original form and the in-register alignment thereof would thus be adversely affected.

An advantageous improved mode of the method provides that, before the sheet is gripped by the sheet retainer, it is stopped by at least one stop acting in the sheet travel direction. This stop thus serves not for aligning the sheet, but only for braking the sheet.

Other features which are considered as characteristic for the invention are set forth in the appended claims.

Although the invention is illustrated and described herein as a device and method for aligning sheets, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
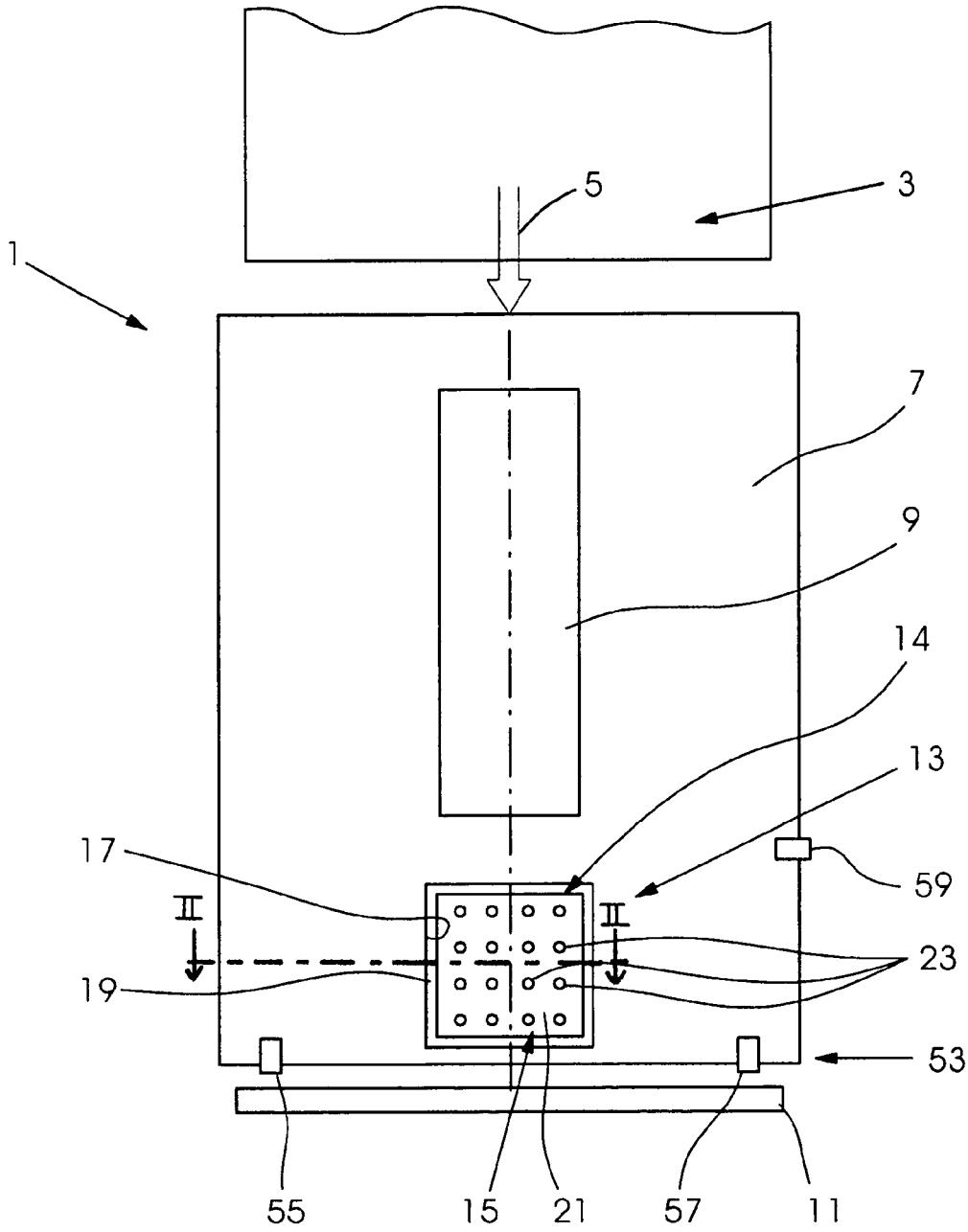
FIG. 1 is a fragmentary top plan view of an exemplary embodiment of a feeder of a sheet-processing machine.

Referring now to the drawings and, first, particularly to FIG. 1 thereof, there is shown therein diagrammatically a feeder 1 (not illustrated in any great detail), for example, an imbricated or stream feeder, for a sheet-processing machine, for example, a sheet-printing machine. Arranged downline from a sheet pile 3, as viewed in a sheet travel direction 5, there is provided a feeding table 7 having a belt drive 9 by which a single separated sheet which has been raised up from the sheet pile 3 by suitable conventional equipment is fed to a feeding system of the machine, the feeding system in the case at hand being formed, purely by way of example, by a pregripper 11.

Provided in an interspace between the belt drive 9 and the pregripper 11 is a device 13 for in-register alignment of a sheet raised up from the sheet pile 3, the device 13 having a sheet-gripping arrangement 14 with a positioning table 15 which, in this case, is square-shaped. The positioning table 15 is arranged in the center of a square through-passageway 17 formed in the feeding table 7, an annular gap 19 being formed between the through-passageway 17 and the positioning table 15 due to the larger size of the through-passageway 17. The positioning table 15 which, in FIG. 1, is arranged in a starting position, has a contact surface 21 for the sheet which is to be aligned, openings 23 being formed in the contact surface 21 and opening out into a chamber 25, which can be seen in FIG. 2. The openings 23 are arranged here, purely by way of example, in a rectangular matrix. The chamber 25 is connected to a non-illustrated negative-pressure source via a flexible negative-pressure tube 27, at least one non-illustrated activatable negative-pressure valve being located in the air path between the negative-pressure source and the chamber 25. If the chamber 25 is subjected to a negative pressure, air is taken into the chamber 25 via the openings 23 in the region of the contact surface 21 of the positioning table 15. The resulting air flows 29 are illustrated by arrows. By sucking away the air in the region of the contact surface 21, a sheet 31 located on the feeding table 7 is held by suction in the region of the contact surface 21 of the positioning table 15 and thus retained in a slippage-free manner on the positioning table 15.

Figure 2:
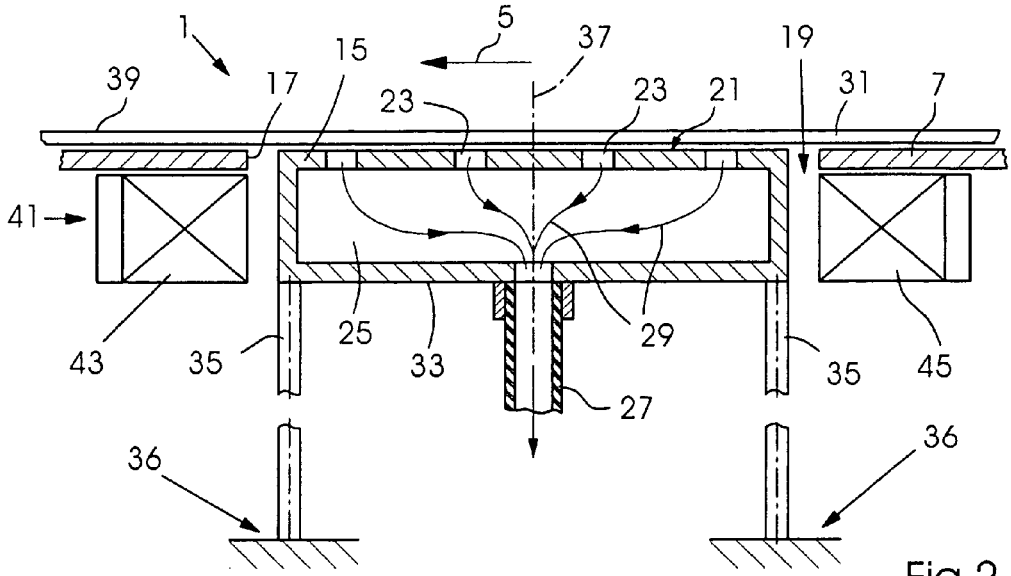
FIG. 2 is a fragmentary enlarged cross-sectional view of FIG. 1 taken along the line II—II through a positioning table.

As is apparent from FIG. 2, provided on the underside 33 of the positioning table 15 are a plurality of, in this case a total of four, elastic bars 35 which are mounted fixed in position on a base 36. The bars 35, which serve for mounting the positioning table 15, retain the latter in a central (starting) position within the through-passageway 17 formed in the feeding table 7 and are constructed so that the positioning table 15 can be displaced in a translatory manner in any desired direction within the plane of the feeding table 7. Furthermore, with the aid of the bars 35, the positioning table 15 has a rotary degree of freedom, i.e., it is pivotable about an imaginary axis 37, which is illustrated by a dot-dash line in FIG. 2 and, in this case, extends orthogonally to the sheet surface 39. The axis 37 extends, in this case, purely by way of example, precisely through the center of the positioning table 15. In another exemplary embodiment, it may also be arranged in a border region of the positioning table 15.

Figure 3:
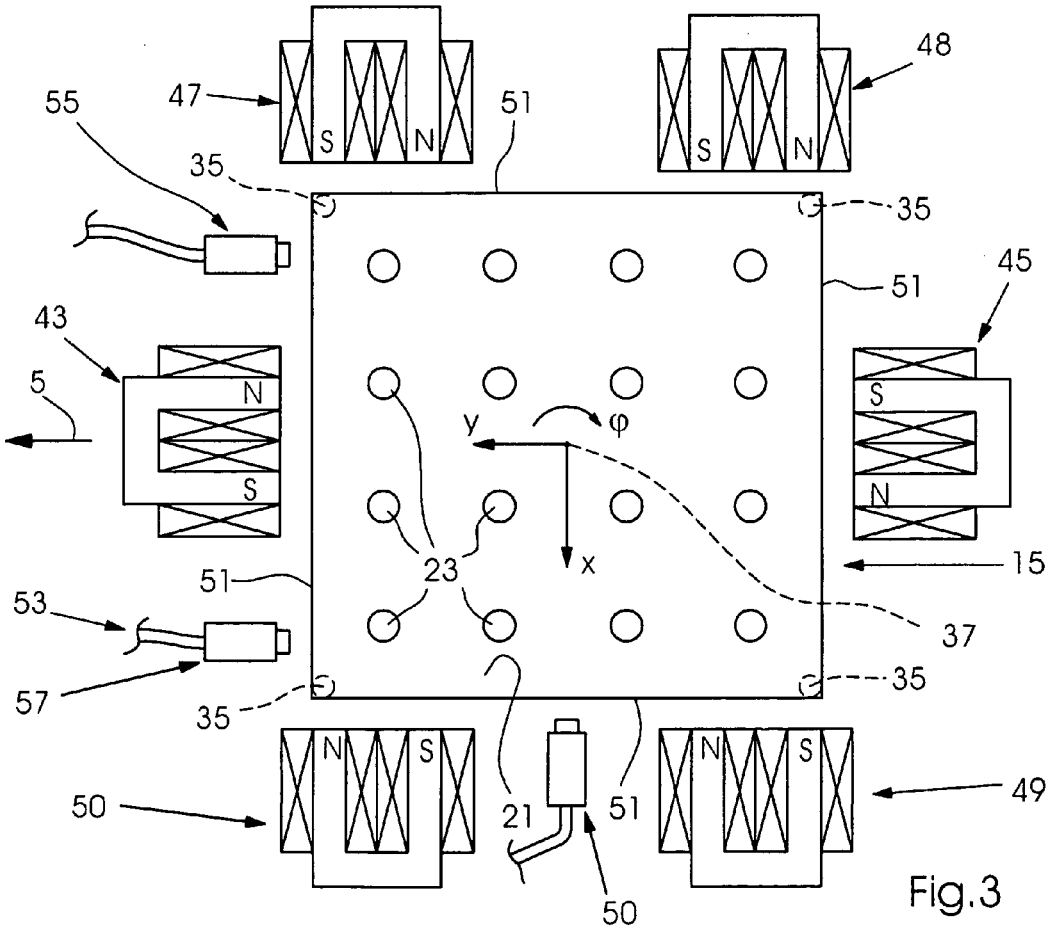
FIG. 3 is a top plan view of FIG. 2, showing the positioning table with the sheet removed, and parts of an exemplary embodiment of an actuating drive.

In order to displace the positioning table 15 within the through-passageway 17, i.e., in particular, to move it in a translatory manner in and transversely to the sheet travel direction and to pivot it about the axis 37 in order to align the sheet 31, which is held by suction on the positioning table, in a desired manner relative to the sheet travel direction 5, an actuating drive 41 is provided which has, in the exemplary embodiment according to FIGS. 2 and 3, an electromagnetic positioning unit with electromagnets 43, 45, 47, 48, 49 and 50. The U-shaped electromagnets 43 to 50 are arranged beneath the feeding table 7 at a spaced distance from the positioning table 15. As is apparent from FIG. 3, which shows the positioning table 15 and the electromagnets 43 to 50 in plan view, the electromagnets are arranged on the circumference of the positioning table 15. Because the electromagnets 43 to 50 do not come into contact with the positioning table 15, it is possible to rule out, in practice, any mechanical wear or damage to the actuating drive 41 and to the positioning table 15.

The positioning table 15 preferably has a very low weight and is produced, for example, from plastic material or aluminum, at least the lateral edges 51 of the positioning table 15 being formed of a ferromagnetic material at least in the regions located opposite the respective electromagnet. Due to suitable activation of the electromagnets 43 to 50, it is possible to vary the magnetic forces acting upon the positioning table 15, with the result that the positioning table 15 can be moved in a translatory manner, as desired, in the y-direction (the sheet travel direction 5) and transversely thereto in the x-direction, and can be pivoted about the axis 37 (in the $\phi$-direction). It is thus readily possible for a sheet fixed on the contact surface 21 of the positioning table 15 to be aligned very precisely in the desired manner by an aforedescribed displacement of the positioning table 15 through the intermediary of the magnet bearings.

As is apparent from FIG. 1, the aligning device 13 also has a sheet-detection device 53, which serves for determining the position of the leading and lateral edges of the sheet. For detecting the position of the leading edge of the sheet, the sheet-detection device 53 has position sensors 55 and 57, and, for detecting the position of the lateral edge of the sheet, the sheet-detection device 53 has a position sensor 59. The position sensors 55, 57 and 59 are constructed so that the respective sheet edge is detected in the direction of the sheet surface. The position sensors 55, 57 and 59 may be formed by a CCD (charge coupled device)-array camera, a capacitor sensor or an ultrasonic sensor. With the aid of the position sensors 55, 57 and 59, it is possible, as with the exemplary embodiment illustrated in FIG. 1, to dispense with front lays and side lays, such as are used in conventional devices, a further discussion of which appears in greater detail hereinbelow.

The aligning device 13 also includes a non-illustrated control and/or regulating device to which the sheet-detection device 53, the electromagnets 43 to 50 and at least one valve for controlling the negative pressure in the chamber 25 are coupled, it being noted that the valve is not illustrated in FIGS. 1 to 3. With the aid of the control and/or regulating device, the sheet which is to be aligned can be displaced into a desired position. For regulating the displacement movement of the positioning table 15, a real-time regulator is provided which takes into account the actual position, determined by the sheet-detection device 53, of the sheet which is to be aligned, in order, depending upon a given regulating strategy, to pass corresponding actuating signals to the electromagnets 43 to 50 and the negative-pressure valve so that the sheet which is to be aligned is secured by suction in a forcelocking manner to the contact surface 21 of the positioning table 15 in dependence upon the machine angle.

The operation or functioning of the control/regulating device is explained in greater detail hereinbelow with reference to FIG. 5, which is a block diagram of an exemplary embodiment for regulating the displacement of the positioning table 15 in the x-direction, i.e., in a direction transverse to the sheet travel direction 5, and a number of components of the control/regulating device. Parts in FIG. 5, which have been described with reference to the preceding figures are identified by the same reference characters, so, in this respect, reference should be made to the description of the preceding figures.

Figure 5:
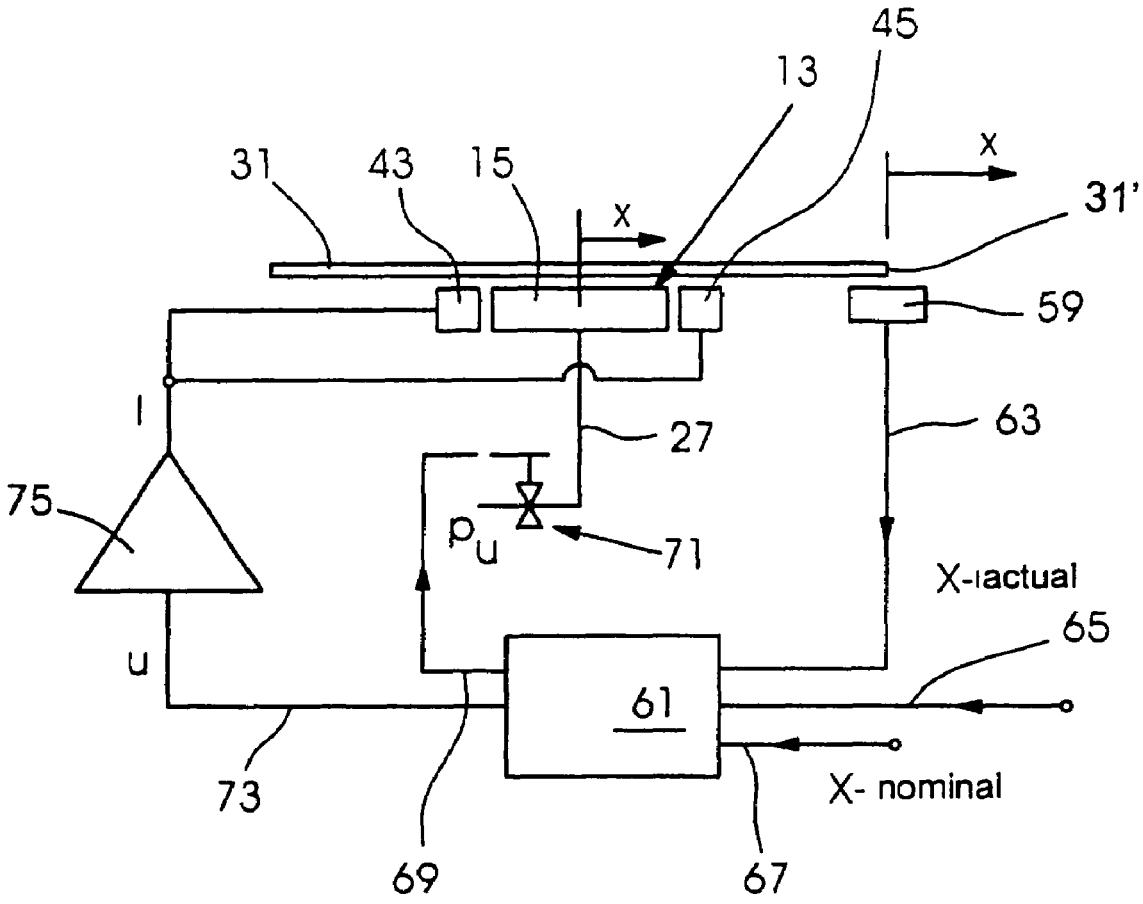
FIG. 5 is a block diagram of a device for regulating the displacement movement of the positioning table in a direction transverse to the sheet travel direction.

FIG. 5 illustrates a regulator 61 to which the position sensor 59 for determining the position of the lateral sheet edge 31' of the sheet 31 which is to be aligned within the feeder 1 is connected via a signal line 63. Furthermore, the rotary angle of the machine is introduced into the regulator 61 via a signal line 65, and the desired or nominal position of the lateral sheet edge 31', namely the X-nominal or desired position, is introduced into the regulator 61 via a signal line 67. In order to control the pressure in the chamber 25 in the positioning table 15, the regulator 61 is connected to a negative-pressure valve 71 via a signal line 69. Furthermore, via a signal line 71, the regulator 61 issues actuating signals (voltage u) to an amplifier 75, via which, in turn, the currents I in the coils of the magnet bearings 43 and 45 are controlled. The intensity of the currents I emitted via the amplifier 75 influence the magnet-bearing forces applied to the positioning table 15, and thus the deflection of the positioning table 15 in the x-direction.

Regarding the operation or functioning of the aligning device 13: a sheet separated from the sheet pile 3 is transported in the sheet travel direction 5 by the belt drive 9 until the sheet is stopped by stops (not illustrated in FIGS. 1 to 3), which are located upline from the position sensors 55 and 57, as viewed in the sheet travel direction (circumferential direction), and is secured by suction by the positioning table 15. The stops then swing back, and the sheet is guided over the position sensors 55 and 57 by way of the positioning table 15. The position determination (CCD-array) or the switching time (optical switch) determines the information (desired/actual deviation) for regulating the position. In a different embodiment of the aligning device wherein no mechanical stops are provided for braking the sheets, control of the negative pressure in the contact surface 21, and thus the stopping and fixing of the sheet, is correspondingly influenced, as an alternative to the mechanical stops, via an additional upline, optical switch, as is used, for example, for premature-sheet/delayed-sheet monitoring. Once the sheet is held in a slippage-free manner on the positioning table 15, the positioning table 15, with the aid of the actuating drive 41, is then displaced translatorily in the sheet travel direction 5 (y-direction) and transversely thereto (x-direction), and, if necessary or desired, pivoted about the axis 37 (ϕ-direction), until the leading sheet edge is disposed, for example, precisely transversely to the sheet travel direction 5 and that lateral edge of the sheet which is detected by the position sensor 59 is disposed parallel to the sheet travel direction 5. The sheet is then received by the pregripper 11 and fed to the machine. During the alignment of the sheet, the position of the latter is constantly determined and used for the purpose of adjusting the positioning table.

Figure 4:
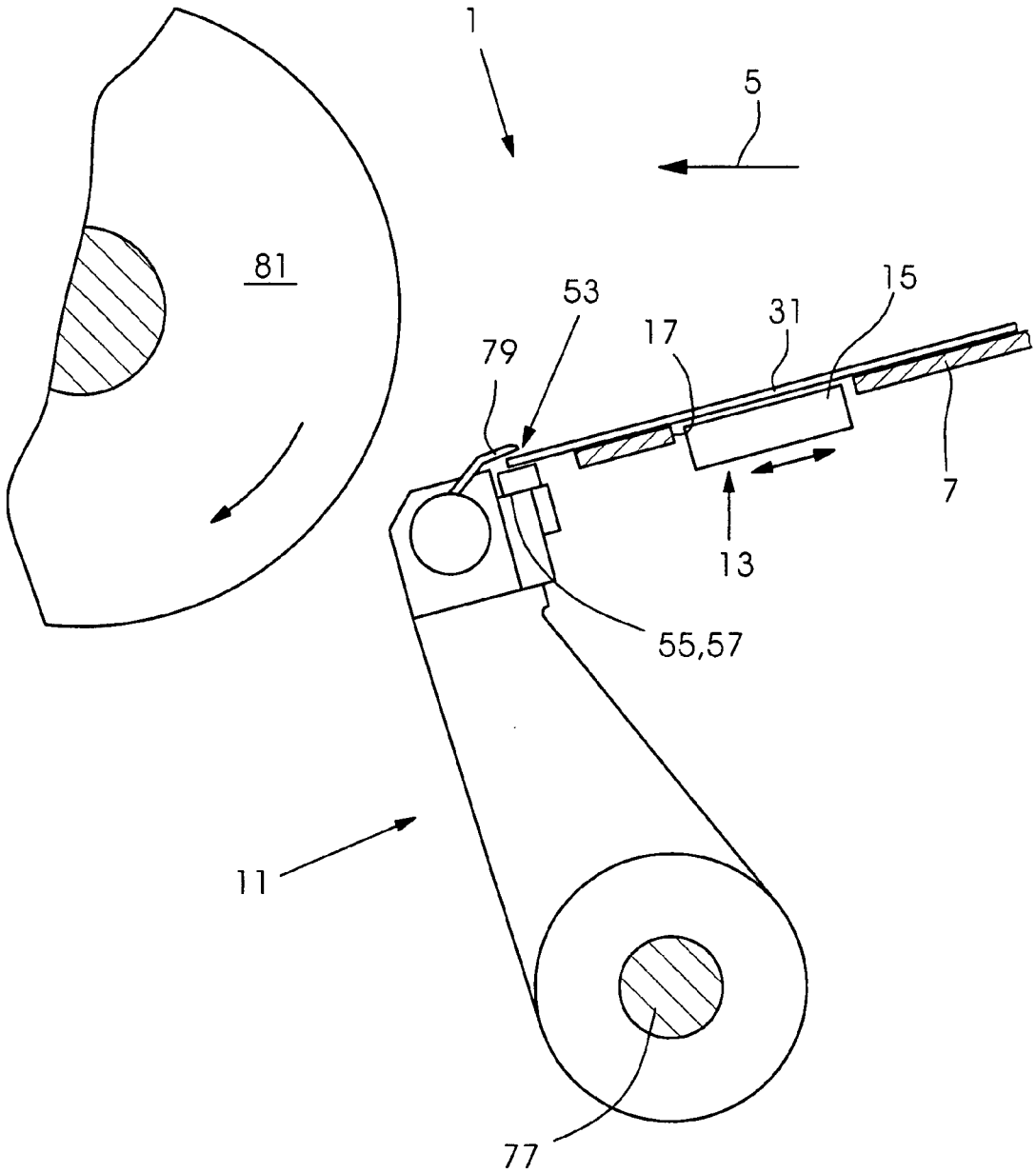
FIG. 4 is a fragmentary side elevational view, partly in section, of another exemplary embodiment of the feeder.

FIG. 4 shows part of an exemplary embodiment of a feeder 1 in side elevational view, namely, a pregripper 11 which is pivotable about a spindle 77 and has at least one gripper 79 for gripping a sheet 31 located on the feeding table 7. Those parts in FIG. 4 which are like parts in FIGS. 1 to 3 are provided with the same reference numerals, so, in this respect, reference may be had to the description of the preceding figures. The pregripper 11, which is reciprocatingly pivotable cyclically or in time with the machine, receives the sheet 31 located on the feeding table 7 after the sheet has been aligned in relation to the sheet travel direction 5, and laterally thereto, by the aligning device 13. By virtue of a pivoting movement, the pregripper 11 transports the sheet 31 to a downline feeding cylinder 81. In the position wherein it rests against the feeding table 7, the pregripper 11 oscillates at the natural mechanical frequency thereof and with a given amplitude. This positional inaccuracy varies from revolution to revolution and changes in dependence upon the transporting speed of the sheets. In order to improve the accuracy of the sheet-detection device 53, in this exemplary embodiment, the position sensors 55 and 57, which serve for detecting the position of the leading edge of the sheet which is to be aligned, are integrated in the pregripper 11. It is thus possible for the positional inaccuracy of the pregripper 11 resulting from the natural oscillation thereof to be corrected by a corresponding displacement of the positioning table 15. A positional inaccuracy of the pregripper 11 relative to the positioning table 15 can thereby be compensated for.

In an exemplary embodiment of the aligning device 13 which is not illustrated in the figures, the magnet-bearing forces are measured in order to monitor whether two sheets are resting on the positioning table 15. Because, for the purpose of positioning the sheet, i.e., in the case of a displacement of the positioning table 15 with the aid of the electromagnets, a current flows in the latter which is dependent upon the mass (force of inertia) of the sheet which is to be moved, it is possible, via the movement of the positioning table 15, to determine the mass of the sheet and thus to establish whether two sheets are present.

In another exemplary embodiment of the aligning device 13, at least one Hall-effect sensor, the construction of which is well known, is disposed in the air gap 19 between the positioning table 15 and the magnet bearings, the Hall-effect sensor aiding in the determination of the magnet-bearing force which is required in order to move the sheet fixed on the positioning table 15. It is thus also possible to use the Hall-effect sensor for monitoring whether two sheets are present.

In an exemplary embodiment of the aligning device which is not illustrated, at least one front lay which serves as a front stop and at least one side lay which serves as a stop for the lateral sheet edge are provided on the feeding table 7. This makes it possible for the sheet to be aligned precisely without position sensors, as are provided in the case of the aforedescribed sheet-detection device 53, because, as the sheet which is fixed forcelockingly on the positioning table 15 strikes against the stops, reaction forces which result in an increase in the force of the electromagnets are produced. The positioning table 15 is displaced until the leading and lateral edges thereof abut the front and side lays, respectively.

Instead of an electromagnet-containing actuating drive 41 for displacing the positioning table 15, it is also readily possible to use other, for example quicker, positioning drives, such as a piezo drive, for example.

Figure 6A:
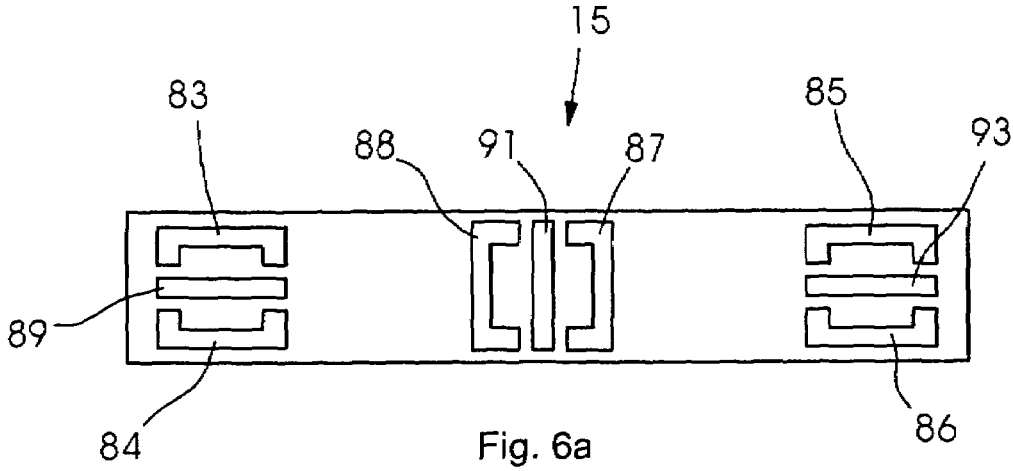
FIG. 6*a* is a bottom plan view of a further different exemplary embodiment of the positioning table with a different embodiment of the actuating drive.
Figure 6B:
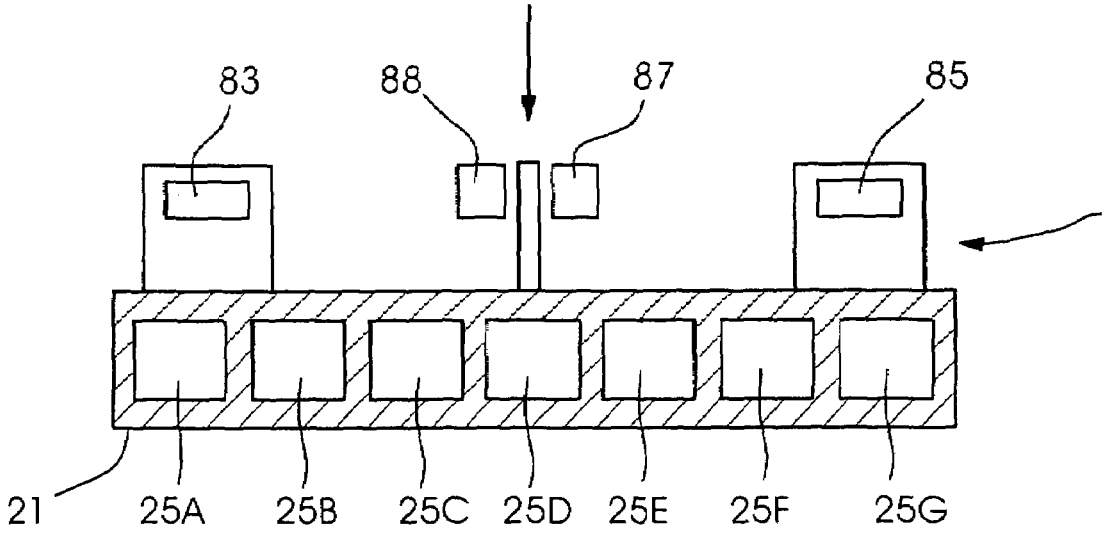
FIG. 6*b* is a longitudinal sectional view of FIG. 6*a;*

FIGS. 6*a* and 6*b* are a bottom plan view and a longitudinal sectional view, respectively, of a further exemplary embodiment of the positioning table 15, which differs from the positioning table described with reference to the preceding figures, in particular, in that it has a plurality of negative-pressure chambers 25A to 25G to which, respectively, at least one of the non-illustrated openings formed in the contact surface 21 is connected. The negative-pressure chambers 25A to 25G are mutually spaced apart side-by-side, as viewed in the sheet travel direction 5, and can be connected to the non-illustrated negative-pressure source, preferably independently of one another, i.e., the pressure in the negative-pressure chambers can be adjusted individually, with the result that it is possible, for example, for individual negative-pressure chambers to be switched off, i.e., in a state wherein negative pressure does not prevail, while the rest of the negative-pressure chambers are subjected to a given negative pressure, which may vary from negative-pressure chamber to negative-pressure chamber.

FIGS. 6*a* and 6*b* also show a further exemplary embodiment of the actuating drive 41, of which the electromagnetic positioning unit is arranged beneath the positioning table 15. The electromagnetic positioning unit has electromagnets 83 to 88, of which the electromagnets 83, 84 and 85, 86 arranged in the respective side-margin or border region on the underside of the positioning table, and the electromagnets 87 and 88 arranged in the center of the positioning table 15 are spaced apart opposite one another. Arranged between the pairs of electromagnets, respectively, is a plate 89, 91 and 93, respectively, which is formed of ferromagnetic material and, in this case, extends perpendicularly to the underside of the positioning table 15, the underside extending parallel to the contact surface 21. As far as the functioning of the electromagnetic positioning unit is concerned, reference may be had to the description of FIGS. 1 to 5.

Figure 7A:
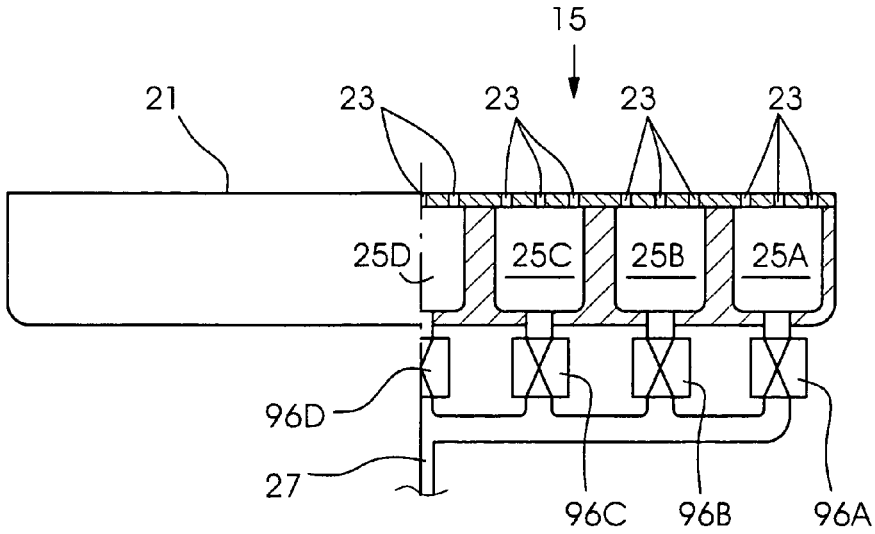
FIG. 7*a* is a diagrammatic side elevational view, partly in section, of yet a further different exemplary embodiment of the positioning table.
Figure 7B:
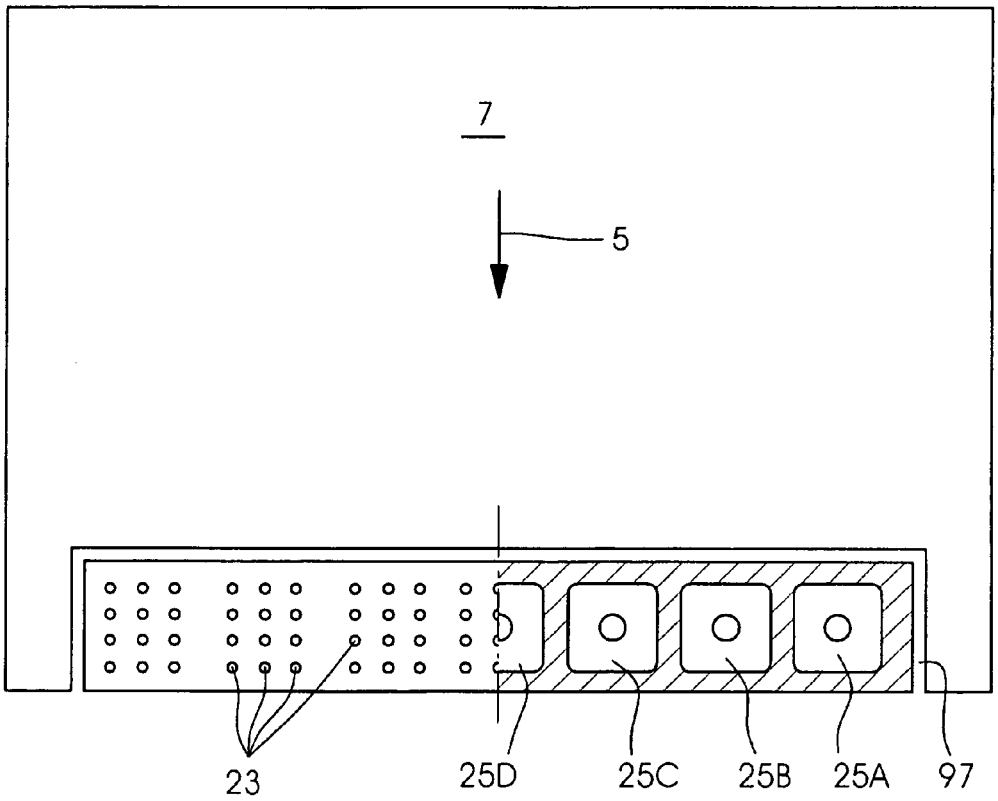
FIG. 7*b* is a top plan view of FIG. 7*b;*

FIGS. 7*a* and 7*b* show a further exemplary embodiment of the positioning table 15. Like parts as those illustrated in the preceding figures are identified in FIGS. 7*a* and 7*b* with the same reference characters, so that, in this respect, reference may be had to the description of the preceding figures. The positioning table 15 has a plurality of negative-pressure chambers which are arranged adjacent to and spaced from one another, only the negative-pressure chambers 25A to 25D of which are shown in FIGS. 7*a* and 7*b*. The negative-pressure chambers 25A to 25D, in this case, are connected to the non-illustrated negative-pressure source via a common flexible negative-pressure tube 27, one activatable negative-pressure valve 96A, 96B, 96C and 96D, respectively, being arranged in the air path between the negative-pressure source and the respective negative-pressure chamber 25A to 25D. As can be seen from both FIGS. 7*a* and 7*b,* in each case, a plurality of openings 23 formed in the contact surface 21 are connected, respectively, to the negative-pressure chambers 25A to 25D. The negative-pressure chambers 25A to 25D, which can be activated, and thus switched on and off, individually, advantageously allow the surface area which is subjected to negative pressure to be adapted to the format of the sheet which is to be aligned.

In the exemplary embodiment of the positioning table 15 which is illustrated in FIGS. 7*a* and 7*b,* the positioning table 15 is arranged in an open-border or open-margin aperture 97 formed in the feeding table 7, to be precise on that side of the feeding table 7 which is directed away from the sheet pile which is not illustrated in FIGS. 7*a* and 7*b*.

Figure 8A:
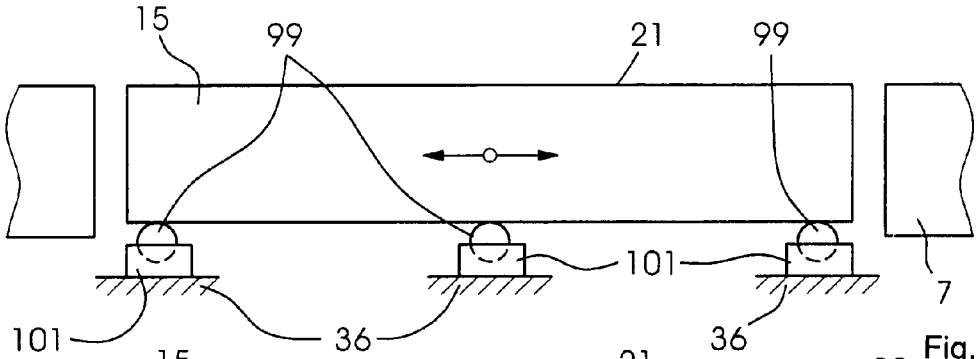
FIGS. 8*a* and 8*b* are diagrammatic side elevational and plan views, respectively, of an exemplary embodiment of a mounting for the positioning table.
Figure 8B:
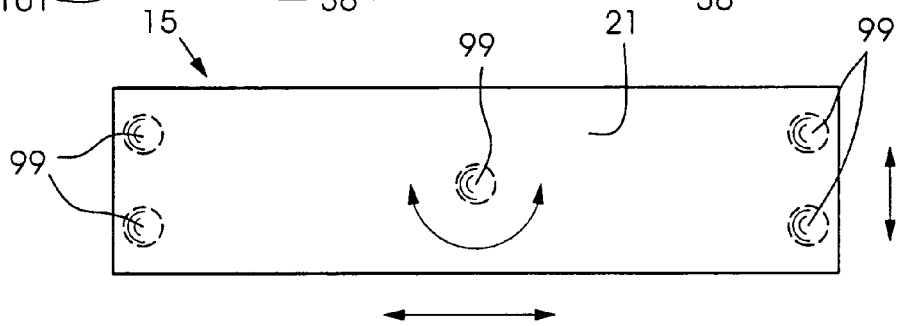

FIG. 8*a* is a side elevational view, and FIG. 8*b* a plan view of a further exemplary embodiment of the positioning table 15, which, in this case, is constructed as a ball table. Ball-type rollers 99 are provided as a mounting support for the positioning table 15, and the ball-type rollers, respectively, are retained rotatably in a respective mount 101 arranged on the base 36. The ball-type rollers 99 support the positioning table 15 and ensure that the latter is movable in the sheet travel direction, perpendicularly to the sheet travel direction and about an axis extending in a direction perpendicular to the contact surface 21, as is indicated by double-headed arrows. The positioning table 15 sliding on the ball-type rollers 99 thus has all three degrees of freedom (in y, x and $\phi$ directions).

Figure 9A:
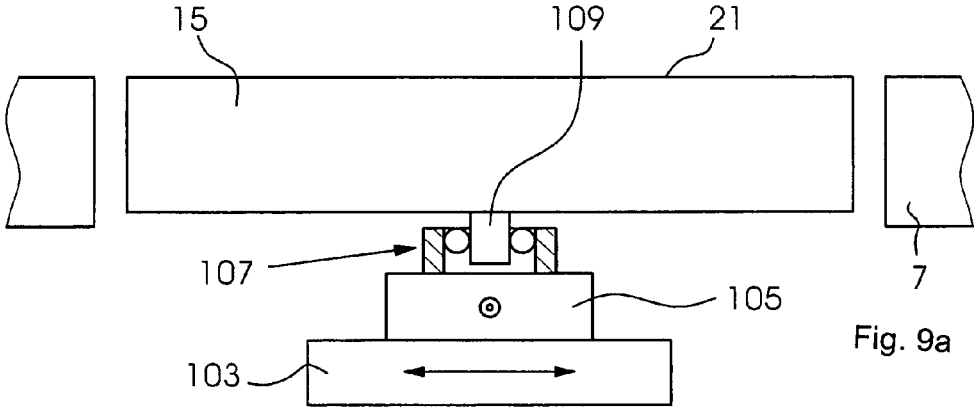
FIGS. 9*a* and 9*b* are diagrammatic side elevational and plan views, respectively, of another exemplary embodiment of the mounting for the positioning table.
Figure 9B:
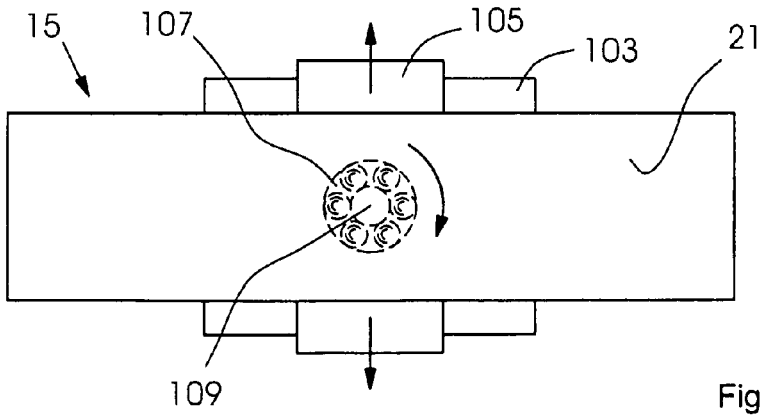

FIG. 9*a* is a side elevational view, and FIG. 9*b* a plan view of yet another exemplary embodiment of the positioning table 15, which, in this case, is formed of a compound-table arrangement having slides 103 and 105 which are arranged above one another and are displaceable relative to one another. The displacement direction of the first slide 103 extends transversely to the sheet travel direction, and the displacement direction of the second slide 105 extends parallel to the sheet travel direction. A mounting support for the positioning table 15, which has a ball bearing 107, is provided on the upper side of the second slide 105. The ball bearing 107 serves for accommodating a bearing pin 109 provided on the underside of the positioning table 15. The compound-table arrangement has, with the aid of the slides 103 and 105, two translatory degrees of freedom and, with the aid of the ball bearing 109, a rotary degree of freedom.

Figure 10:
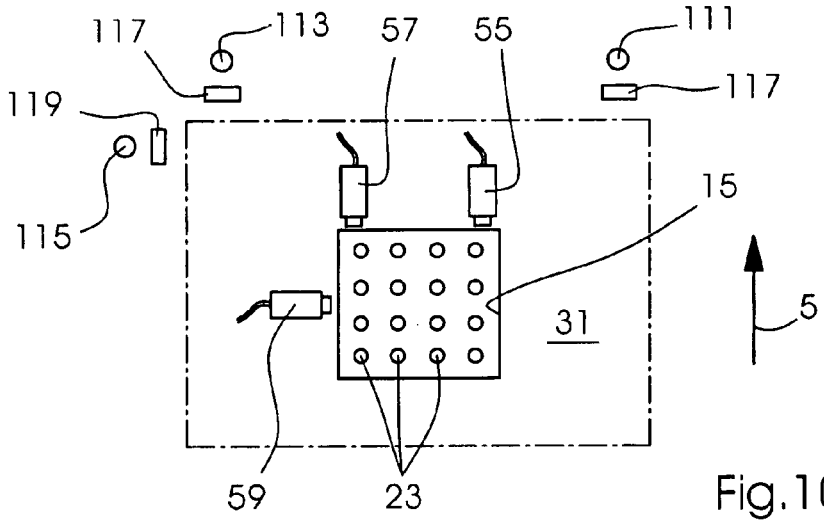
FIGS. 10 and 11 are respective plan views of further exemplary embodiments of the positioning table.
Figure 11:
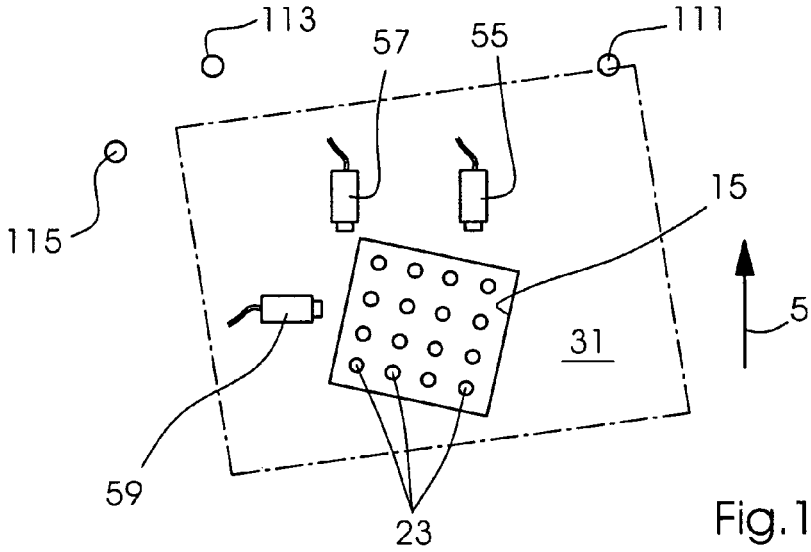

FIGS. 10 and 11 illustrate further particularly advantageous embodiments and the method according to the invention of aligning the sheets with the aid of sheet-edge sensors 111, 113 and 115. Parts which have already been described with reference to the preceding figures are identified by the same reference numerals, so that, in this respect, reference may be had to the description of FIGS. 1 to 9.

In the exemplary embodiment illustrated in FIG. 10, the sheet-edge sensors 111 and 113 are assigned to the leading edge of the sheet 31 and, respectively, have a stop 117 disposed upline therefrom, as viewed in the sheet travel direction S. Also provided is a stop 119 for the lateral edge of the sheet 31, this stop 119 being disposed upline from the sheet-edge sensor 115, as viewed in a direction perpendicular to the sheet travel direction 5. The stops 117 and 119 serve exclusively for stopping the incoming sheet 31. Only after the sheet transported from the sheet pile to the positioning table has been stopped is it fixed forcelockingly on the positioning table. The stops 117 and 119 are then displaced into a neutral position, wherein they do not disrupt the alignment of the sheet 31 or further transportation thereof, and the sheet 31 moves in the direction towards the sheet-edge sensors 111, 113, 115 by the movable positioning table 15. When a sheet edge is detected, the sheet-edge sensor produces a TTL (Transistor-Transistor-Logic) pulse, the voltage level of which can rise from 0 V to 5 V, as can be seen in the diagram illustrated in FIG. 12. At this point in time, the position of the positioning table 15 is sensed with the aid of the position sensors 55, 57, 59. After all of the sheet-edge sensors 111, 113, 115 have detected the sheet edge, it is possible to calculate the position of the sheet on the positioning table 15. After the actual position of the sheet has been calculated, the sheet can be moved into the desired position in the manner described hereinabove.

The exemplary embodiment illustrated in FIG. 11 differs from the exemplary embodiment illustrated in FIG. 10, in particular, in that no stops are provided for braking and stopping the incoming sheet prior to the alignment thereof by the positioning table 15. The sheet is braked into the standstill position, in this case, by subjecting the openings 23 to negative pressure, with the result that the sheet is retained forcelockingly on the contact surface 21 of the positioning table 15. The alignment of the sheet takes place in the same way as in the case of the exemplary embodiment described with reference to FIG. 10.

It should be noted that, in the exemplary embodiments described with reference to FIGS. 10 and 11, there is no need for any front and side lays for the precise alignment of the sheet 31. The stops 117, 119 serve exclusively for braking the incoming sheet and bringing it to a standstill.

Figure 12:
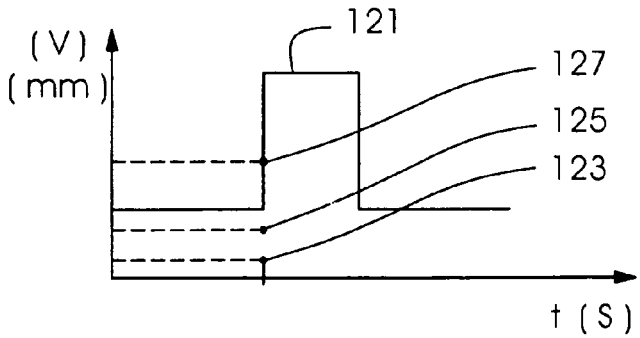
FIG. 12 is a plot diagram illustrating the time rate of change of a control signal of a sheet-detecting sensor.

The TTL pulse produced by a sheet-edge sensor is illustrated by the characteristic curve 121 in FIG. 12. In addition, the signal of the position sensor 55 is indicated by a dot 123, the signal of the position sensor 57 is indicated by a dot 125 and the signal of the position sensor 59 is indicated by a dot 127.

The aligning device 13 described with reference to the figures is installable particularly advantageously upline of a printing unit of the sheet-processing machine. Because there are no front and side lays used for aligning the sheets, the desired or nominal position of the sheet is variable. It is thus possible for a difference in register of the first printing unit, which is thus arranged, preferably directly, downline from the positioning table, to be compensated for by a corresponding change in the desired or nominal position of the sheet, with the aid of the positioning table 15, in the sheet travel (circumferential) direction and lateral direction. It is thus possible, if necessary or desirable, to dispense with a side register and a circumferential register in the first printing unit, which simplifies the construction of the machine.

It is particularly advantageous, in the case of the sheets being aligned in a contactless, and thus deformation-free and bracing-free manner, with the aid of the aligning device according to the invention, that narrower and wider printing and ghosting can be avoided reliably.

We claim:

1. A device for aligning a sheet prior to transferring the sheet to a sheet-processing machine, comprising:

at least one sheet-gripping device for displaceably aligning the sheet, said sheet-gripping device having a single displaceable positioning table and an actuating drive for selectively contactlessly displacing said positioning table in a plurality of directions selected from the group consisting of a sheet travel direction, a direction transverse to said sheet travel direction, and a rotation about an axis extending in a direction orthogonal to said sheet travel direction, the sheet to be aligned being fixable on said positioning table.

2. The sheet-aligning device according to claim 1, wherein said positioning table has at least one contact surface engageable by the sheet, said contact surface being formed with at least one opening connectable to a negative-pressure source.

3. The sheet-aligning device according to claim 2, including a control device for adjusting the negative pressure to which said at least one opening formed in said contact surface of said positioning table is subjected.

4. The sheet-aligning device according to claim 1, wherein said positioning table is formed with a plurality of openings, respectively, connected to different negative-pressure chambers, which are separated from and disposed side-by-side one another, as viewed in the sheet travel direction, said negative-pressure chambers being connected to said negative-pressure source independently of one another.

5. The sheet-aligning device according to claim 1, wherein said positioning table is integrated in a feeding table.

6. The sheet-aligning device according to claim 1, wherein said positioning table has an underside facing away from said contact surface thereof, and including a plurality of elastic bars engaged by said positioning table at said underside thereof so that the weight of said positioning table is supported thereby.

7. The sheet-aligning device according to claim 1, wherein said positioning table is constructed as at least one of a ball table and a compound-table arrangement.

8. The sheet-aligning device according to claim 1, wherein said actuating drive has an electromagnetic positioning unit with at least one electromagnet, which is fixed in position relative to said positioning table and is assigned to one of a circumferential region of the positioning table and to a location arranged beneath said positioning table.

9. The sheet-aligning device according to claim 8, wherein said electromagnet is U-shaped.

10. The sheet-aligning device according to claim 8, including a control device for activating said at least one electromagnet.

11. The sheet-aligning device according to claim 8, including a measuring device for determining the electric current flowing through said at least one electromagnet.

12. The sheet-aligning device according to claim 8, including at least one Hall-effect sensor disposed in a bearing gap between said positioning table and at least said one electromagnet.

13. The sheet-aligning device according to claim 1, wherein said positioning table is of polygonal construction.

14. The sheet-aligning device according to claim 13, wherein said positioning table is square.

15. The sheet-aligning device according to claim 1, comprising a sheet-detection device for determining the position of at least one of a leading sheet edge and a lateral sheet edge and having at least one position sensor for detecting the sheet edge in the direction of the sheet surface.

16. The sheet-aligning device according to claim 15, wherein said position sensor assigned to said leading sheet edge is disposed on a pregripper cyclically displaceable with the machine.

17. The sheet-aligning device according to claim 15, wherein said position sensor is formed by one of a CCD-array camera, a capacitive sensor and an ultrasonic sensor.

18. The sheet-aligning device according to claim 15, wherein said sheet-detection device is coupled with a control device to form a regulating circuit.

19. A method of aligning sheets prior to transferring the sheets to a sheet-processing machine, which comprises:

gripping by at least one sheet retainer a respective sheet to be aligned;

displacing the sheet into a desired position on a single positioning table; and aligning at least one of a leading sheet edge in a direction transverse to a sheet travel direction and lateral sheet edges in a direction parallel to the sheet travel direction by contactlessly displacing the positioning table in at least one of a sheet travel direction, a direction transverse to the sheet travel direction, and a direction pivoting about an axis extending in a direction orthogonal to the sheet travel direction.

20. The method according to claim 19, which includes, before gripping the sheet by the sheet retainer, stopping the sheet by at least one stop acting in the sheet travel direction.

* * * * *